US009051151B2

(12) United States Patent
Castillo et al.

(10) Patent No.: US 9,051,151 B2
(45) Date of Patent: Jun. 9, 2015

(54) SPLICING APPARATUS FOR UNWINDING STRANDS OF MATERIAL

(75) Inventors: Mario Castillo, Cincinnati, OH (US); Peter Nöthen, Weilerswist (DE); Daniel Wirtz, Mechernich (DE)

(73) Assignee: The Procter & Gamble Company, Cincinnati, OH (US)

( * ) Notice: Subject to any disclaimer, the term of this patent is extended or adjusted under 35 U.S.C. 154(b) by 606 days.

(21) Appl. No.: 13/289,207

(22) Filed: Nov. 4, 2011

(65) Prior Publication Data

US 2013/0112800 A1 May 9, 2013

(51) Int. Cl.

| | |
|---|---|
| ***B65H 69/06*** | (2006.01) |
| ***B65H 49/10*** | (2006.01) |
| ***B65H 57/20*** | (2006.01) |
| ***B65H 49/12*** | (2006.01) |

(52) U.S. Cl.

CPC ..... *B65H 57/20* (2013.01); *B65H 49/12* (2013.01); *B65H 2701/31* (2013.01)

(58) Field of Classification Search

USPC ..... 242/551, 554, 555, 555.3, 555.4, 563, 242/128, 131–131.1, 566

See application file for complete search history.

(56) References Cited

U.S. PATENT DOCUMENTS

| | | | | |
|---|---|---|---|---|
| 1,459,694 | A | | 6/1923 | Holder |
| 1,547,596 | A | | 7/1925 | Longvall |
| 1,578,488 | A | | 3/1926 | Howard |
| 2,021,032 | A | | 11/1935 | Swanson |
| 2,602,606 | A | | 7/1952 | Hanse |
| 2,809,791 | A | | 10/1957 | Haworth |
| 2,851,228 | A | | 9/1958 | Keck |
| 2,942,802 | A | | 6/1960 | Bachus |
| 3,073,545 | A | | 1/1963 | Frate et al. |
| 3,150,845 | A | * | 9/1964 | Pool ..... 242/131 |
| 3,175,784 | A | * | 3/1965 | Dambrogio ..... 242/128 |
| 3,315,917 | A | | 4/1967 | Brown |
| 3,428,269 | A | * | 2/1969 | Fry et al. ..... 242/128 |
| 3,637,155 | A | | 1/1972 | Pato |
| 4,074,871 | A | | 2/1978 | Stotler |
| 4,100,721 | A | * | 7/1978 | Seiichi et al. ..... 57/294 |
| 4,180,218 | A | | 12/1979 | Jacobs |
| 4,235,393 | A | | 11/1980 | Schenkel et al. |
| 4,298,174 | A | | 11/1981 | Kovaleski |
| 4,402,467 | A | | 9/1983 | Kontz |
| 4,515,328 | A | | 5/1985 | Payne, Jr. |
| 4,673,140 | A | | 6/1987 | Boles |
| 4,687,151 | A | | 8/1987 | Memminger et al. |
| 5,692,698 | A | | 12/1997 | Forbes |
| 5,709,354 | A | | 1/1998 | Blandin et al. |

(Continued)

FOREIGN PATENT DOCUMENTS

| | | |
|---|---|---|
| BE | 1 009 581 A3 | 5/1997 |
| CH | 223 815 A | 10/1942 |

(Continued)

OTHER PUBLICATIONS

International Search Report, dated Mar. 5, 2013, 10 pages.

(Continued)

*Primary Examiner* — William E Dondero

(74) *Attorney, Agent, or Firm* — Charles R. Matson; Charles R. Ware

(57) ABSTRACT

A splicing apparatus for continuously unwinding strands of material from wound packages.

13 Claims, 9 Drawing Sheets

(56) References Cited

U.S. PATENT DOCUMENTS

| | | | | |
|---|---|---|---|---|
| 5,749,210 | A | 5/1998 | Kikuchi et al. | |
| 5,975,457 | A | 11/1999 | Forbes | |
| 6,076,763 | A | 6/2000 | Spatafora | |
| 6,345,783 | B1 | 2/2002 | Worner | |
| 6,386,477 | B1 | 5/2002 | Kaufmann et al. | |
| 6,533,212 | B1 | 3/2003 | Tafel, II | |
| 6,676,054 | B2 | 1/2004 | Heaney et al. | |
| 6,722,606 | B2 | 4/2004 | Hanson et al. | |
| 6,786,264 | B1 | 9/2004 | Torres Martinez | |
| 6,820,837 | B2 | 11/2004 | Long | |
| 6,923,401 | B2 * | 8/2005 | Lock | 242/553 |
| 7,527,216 | B2 | 5/2009 | Manning, Jr. et al. | |
| 7,540,174 | B2 | 6/2009 | Snijders | |
| 7,621,479 | B2 | 11/2009 | Matzenmüller | |
| 7,806,360 | B2 | 10/2010 | Chadwick | |
| 7,878,447 | B2 | 2/2011 | Hartzheim | |
| 7,887,001 | B2 * | 2/2011 | Yoon et al. | 242/131 |
| 7,896,282 | B2 * | 3/2011 | Barea | 242/418 |
| 7,905,446 | B2 | 3/2011 | Hartzheim | |
| 2004/0104299 | A1 | 6/2004 | Heaney et al. | |
| 2005/0133653 | A1 | 6/2005 | Heaney et al. | |
| 2005/0278914 | A1 * | 12/2005 | Bartkowiak et al. | 28/248 |
| 2006/0131459 | A1 * | 6/2006 | Barea | 242/554 |
| 2011/0042012 | A1 | 2/2011 | Benner et al. | |
| 2011/0127364 | A1 | 6/2011 | Rees et al. | |
| 2012/0217337 | A1 | 8/2012 | Barea | |
| 2013/0161431 | A1 | 6/2013 | Yanez, Jr. et al. | |

FOREIGN PATENT DOCUMENTS

| | | | |
|---|---|---|---|
| DE | 972 011 | U | 11/1967 |
| DE | 1449659 | A1 * | 3/1969 |
| DE | 38 33 434 | C1 | 12/1989 |
| DE | 102 24 909 | A1 | 12/2003 |
| EP | 0 045 854 | A1 | 2/1982 |
| FR | 2 104 228 | A5 | 4/1972 |
| GB | 598 999 | A | 3/1948 |
| GB | 2 172 617 | A | 2/1986 |
| JP | 02 11172 | U | 1/1990 |
| JP | 06 287843 | A | 10/1994 |
| JP | 08 151169 | A | 6/1996 |
| JP | 2001 025868 | A | 1/2001 |
| WO | WO 02/077685 | A1 | 10/2002 |

OTHER PUBLICATIONS

Over End Take Off Elastic Unwind Systems Equipment Overview, 14 pages, 2005.

* cited by examiner

SPLICING APPARATUS FOR UNWINDING STRANDS OF MATERIAL

FIELD

The present disclosure relates to an apparatus for unwinding strands of material from wound packages. In particular, the present disclosure relates to a splicing apparatus for continuously unwinding strands of material from wound packages.

BACKGROUND

Take off equipment is used to unwind strands of material that have been pre-wound onto cores. The pre-wound cores are called packages. Take off equipment unwinds a strand and then feeds the unwound strand to downstream equipment. Take off equipment can unwind packages in sequence while continuously feeding the downstream equipment. Each package has a single continuous strand of material with a leading end and a trailing end. In a take off process, the trailing end of a first package can be joined to the leading end of second package.

As take off equipment finishes unwinding the first (active) package, it pulls off the trailing end, which pulls off the leading end of the second (standby) package, which begins the unwinding of the second package. The standby package becomes the new active package. The finished first package can be replaced with a new standby package. This process of connecting ends and replacing packages can be repeated indefinitely. Thus, in a take off process, there is no need to stop the downstream equipment to replace packages.

One type of take-off equipment uses rotating arms. Each arm has one or more strand guides to direct the strand. For this type of take-off equipment, to transfer the unwinding from an active package to a standby package at line speed, the strand must be properly routed to enable the strand to maintain a proper orientation with respect to the packages, the strand guides, and the downstream equipment.

SUMMARY

Embodiments of the present disclosure use a splicing apparatus to properly route strands of material as the strands are transferred from active packages to standby packages, during the unwinding process. Using the splicing apparatus enables the strand to maintain a proper orientation with respect to the packages, strand guides, and downstream equipment. This is especially useful for processes that unwind strands with rotatable arms. As a result, take off equipment can unwind packages in sequence while continuously feeding the downstream equipment.

BRIEF DESCRIPTIONS OF DRAWINGS

DETAILED DESCRIPTION

Embodiments of the present disclosure use a splicing apparatus to properly route strands of material as the strands are transferred from active packages to standby packages, during the unwinding process. Using the splicing apparatus enables the strand to maintain a proper orientation with respect to the packages, strand guides, and downstream equipment. This is especially useful for processes that unwind strands with rotatable arms. As a result, take off equipment can unwind packages in sequence while continuously feeding the downstream equipment.

Embodiments of the present disclosure can be used with all kinds of strands (and bands), of various sizes and shapes, made from different materials. For example, embodiments of the present disclosure can be used to unwind string, elastic, metal wire, etc.

Figure 1:
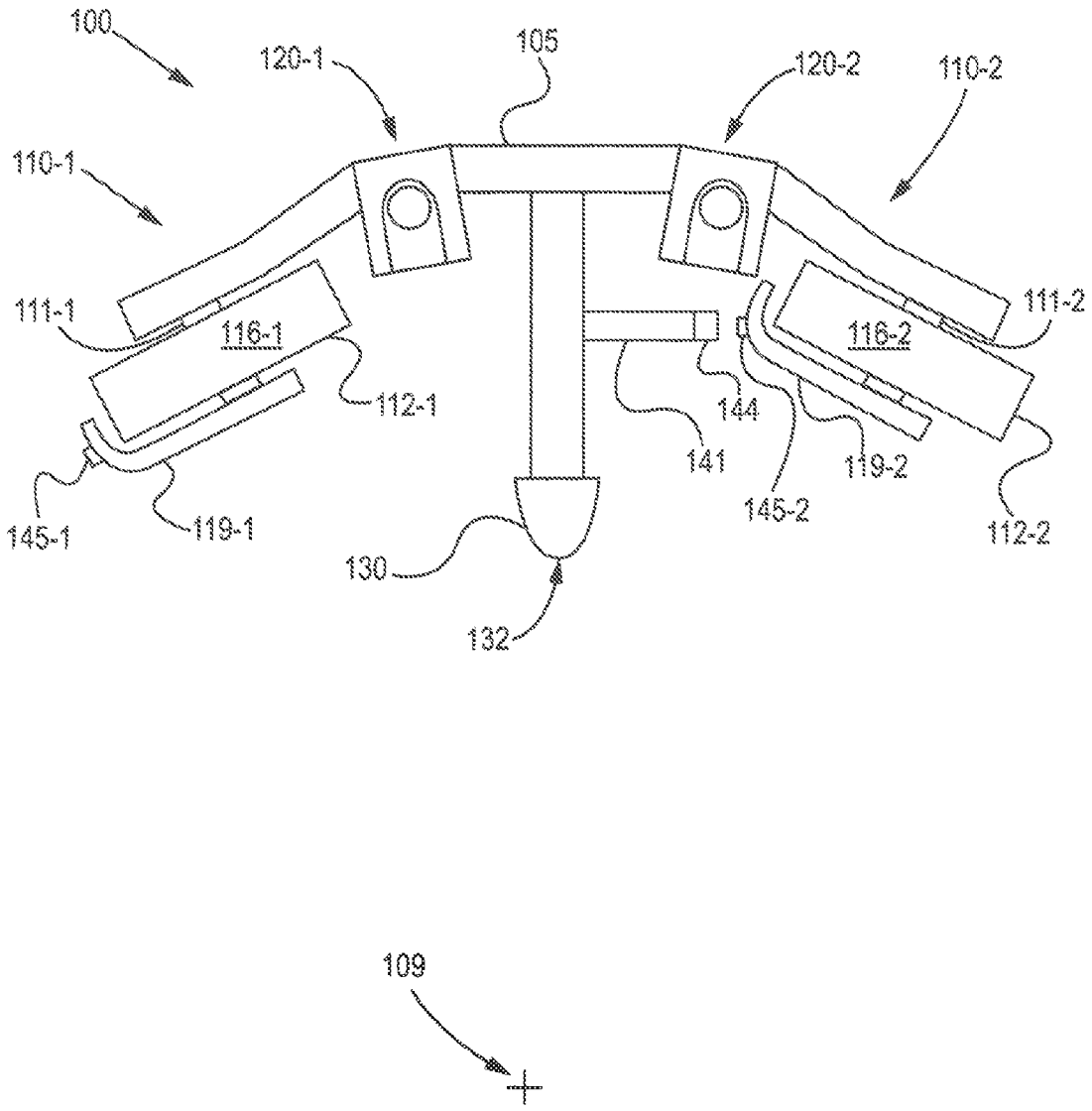
FIG. 1 illustrates a top view of a machine with a splicing apparatus for routing strands of material as the strands are transferred from an active package to a standby package, during an unwinding process that use rotatable arms.

FIG. 1 illustrates a top view of a machine 100. The machine 100 includes a take-off apparatus for unwinding strands of material from wound packages, by using rotatable arms. It is contemplated that either or both of the rotatable arms of FIG. 1 can be the rotatable arms described in US patent application entitled "Apparatus with Rotatable Arm for Unwinding Strands of Material" filed on Nov. 4, 2011 by The Procter & Gamble Company under attorney docket number (TBD) in the name of Castillo, et al., which is hereby incorporated by reference. The machine 100 also includes a splicing apparatus for routing strands of material as the strands are transferred from an active package to a standby package, during an unwinding process.

The take-off apparatus includes a first package unwind station 110-1 and a second package unwind station 110-2, mounted to a frame 105. The first package unwind station 110-1 includes a first holder 111-1 for holding a package, and the second package unwind station 110-2 includes a second holder 111-2 for holding a package.

In FIG. 1, a first package 112-1 is loaded into the first package unwind station 110-1. The first package 112-1 includes a strand of material wound onto a cylindrical core. The first package 112-1 also has an overall shape that is cylindrical, with substantially flat ends and a side 116-1, which is the curved surface around the circumference of the cylindrical shape. The front end of the first package 112-1 is angled toward a downstream infeed location 109. A first rotating arm 119-1 is configured to unwind a strand from the first package 112-1 to the downstream infeed location 109.

Also, in FIG. 1, a second package 112-2 is loaded into the second package unwind station 110-2. The second package 112-2 includes a strand of material wound onto a cylindrical core. The second package 112-2 also has an overall shape that is cylindrical, with substantially flat ends and a side 116-2, which is the curved surface around the circumference of the cylindrical shape. The front end of the second package 112-2 is angled toward the downstream infeed location 109. A second rotating arm 119-2 is configured to unwind a strand from the second package 112-2 to the downstream infeed location 109.

The splicing apparatus includes a first collapsible splice trigger 120-1, a splice wrap housing 130, a second splice trigger 120-2, and a holding arm 141. The collapsible splice triggers 120-1 and 120-2 and the splice wrap housing 130 are described below.

The splice wrap housing 130 has a contact surface 132. The splice wrap housing 130 can be made from various solid materials that are rigid and sturdy. For example, the splice wrap housing 130 can be made from plastic, metal, ceramic, wood, etc. The contact surface 132 can be made from various solid materials that are hard. For example, the strand guides can be made from plastic, metal, ceramic, etc.

A magnet 144 is mounted to the distal end of the holding arm 144. The magnet 144 attracts a piece of ferrous material 145-2 attached to the distal end of the second rotatable arm 119-2. The holding arm 144 is swung toward the second package unwind station 110-2. Thus, the holding arm 144 can hold the second rotatable arm 119-2 in a predetermined position, by using magnetic force. A piece of ferrous material 145-1 is also attached to the distal end of the first rotatable arm 119-1. The holding arm 144 can also be swung toward the first package unwind station 110-1, to hold the first rotatable arm 119-1 in a predetermined position.

Figure 2:
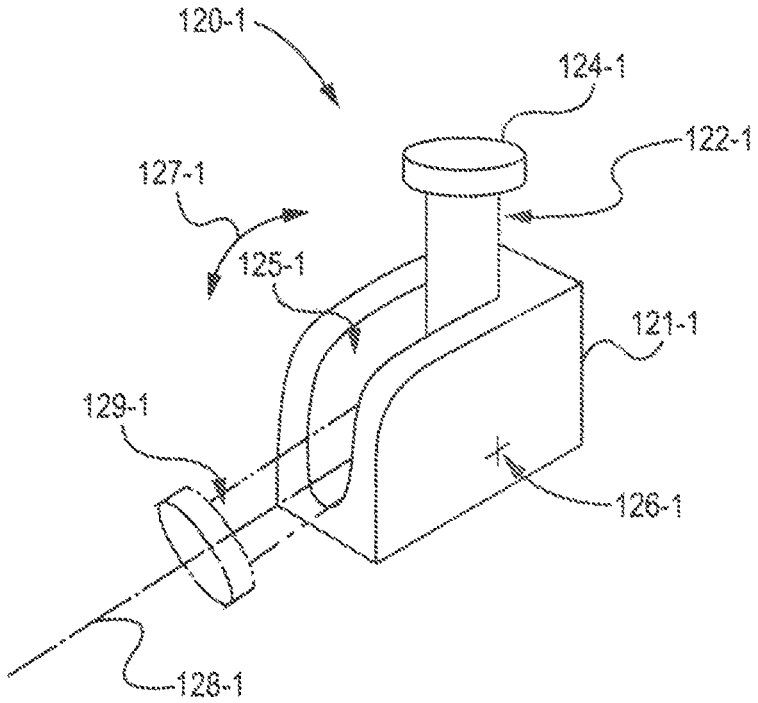
FIG. 2 illustrates an isometric view of a splice trigger used in the splicing apparatus of FIG. 1.

FIG. 2 illustrates an isometric view of the first collapsible splice trigger 120-1 used in the splicing apparatus of FIG. 1. In FIG. 2, the collapsible splice trigger 120-1 is in its upright (vertical) position. The splice trigger 120-1 includes a body 121-1 and a pin. The body 121-1 has a slot 125-1 and the pin is set in the slot 125-1. The pin has a first contact surface 122-1 and a cap 124-1. The collapsible splice trigger 120-1 is configured to collapse when a predetermined force (based on the desired strand tension during splicing and based on the breaking strength of the strand) pulls the pin forward in the slot 125-1. When the collapsible splice trigger 120-1 collapses, the pin is configured to move in the slot 125-1 by rotating 127-1 around an axis 126-1, to a collapsed (horizontal) position 129-1. In the collapsed position 129-1, the pin points in a first collapse direction 128-1. Once collapsed the collapsible splice trigger 120-1 can be reset to its upright position.

The collapsible splice trigger 120-1 can be made from various solid materials that are rigid and sturdy. For example, the collapsible splice trigger 120-1 can be made from plastic, metal, ceramic, wood, etc. The first contact surface 122-1 can be made from various solid materials that are hard. For example, the strand guides can be made from plastic, metal, ceramic, etc. The collapsible splice trigger 120-1 can be configured with a spring to collapse at the predetermined force. The second collapsible splice trigger 120-2 can be configured in the same way as the first collapsible splice trigger 120-1.

Figure 3:
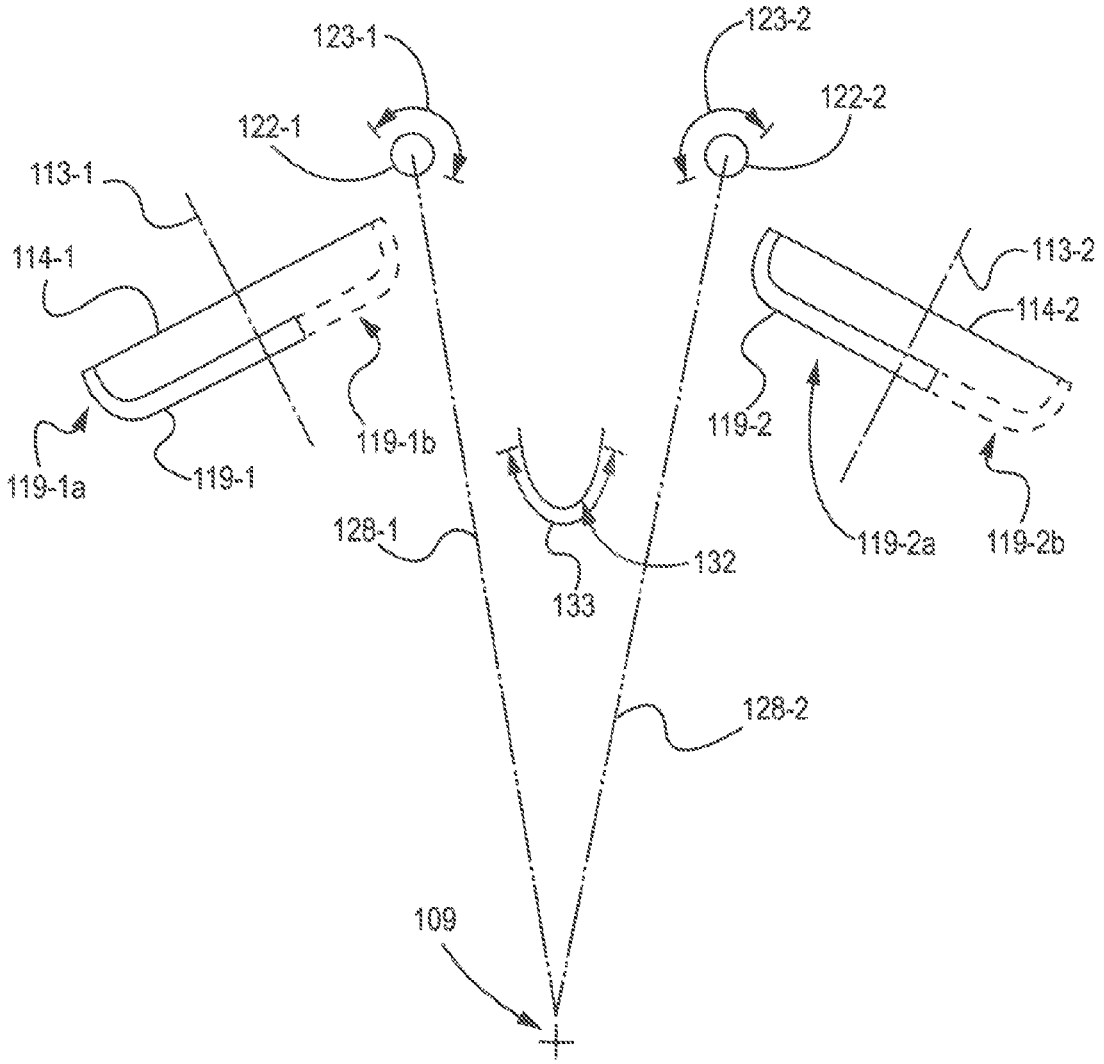
FIG. 3 illustrates a top view of portions of the splicing apparatus of FIG. 1.

FIG. 3 illustrates a top view of portions of the splicing apparatus of FIG. 1. FIG. 3 shows the first rotatable arm 119-1 of FIG. 1 in a first position 119-1*a*, and rotated around a first rotational axis 113-1 to an alternate position 119-1*b*. In FIG. 3, the first rotatable arm 119-1 is an unpowered arm. The first rotatable arm 119-1 is configured to unwind a strand from the first package 112-1 of FIG. 1 to the downstream infeed location 109. The first rotatable arm 119-1 includes a first strand guide, and the rotation of the first rotatable arm 119-1 around the first rotational axis 113-1 defines a first circular path 114-1 for a distal end of the first strand guide.

FIG. 3 also shows the contact surface 122-1 of the first collapsible splice trigger 120-1 with a wrap angle 123-1 formed by the portion of the first contact surface 122-1 that is contacted by a strand routed through the splicing apparatus. The first collapsible splice trigger 120-1 has a first collapse direction 128-1, which points substantially toward the downstream infeed location 109. As used herein, when the word substantially is applied to directions, the word substantially means within 0-30° (or any integer value within this range) of the specified direction.

FIG. 3 further shows the contact surface 132 of the splice wrap housing 130 with a wrap angle 133 formed by the portion of the contact surface 132 that is contacted by a strand routed through the splicing apparatus. The wrap angle 133 can be between 275 and 315 degrees.

FIG. 3 shows the contact surface 122-2 of the second collapsible splice trigger 120-2 with a wrap angle 123-2 formed by the portion of the second contact surface 122-2 that is contacted by a strand routed through the splicing apparatus. The second collapsible splice trigger 120-2 has a second collapse direction 128-2, which points substantially toward the downstream infeed location 109.

FIG. 3 also shows the second rotatable arm 119-2 of FIG. 1 in a second position 119-2*a*, and rotated around a second rotational axis 113-2 to an alternate position 119-2*b*. In FIG. 3, the second rotatable arm 119-2 is an unpowered arm. The second rotatable atm 119-2 is configured to unwind a strand from the second package 112-2 of FIG. 1 to the downstream infeed location 109. The second rotatable arm 119-2 includes a second strand guide, and the rotation of the second rotatable arm 119-2 around the second rotational axis 113-2 defines a second circular path 114-2 for a distal end of the second strand guide.

Figure 4A:
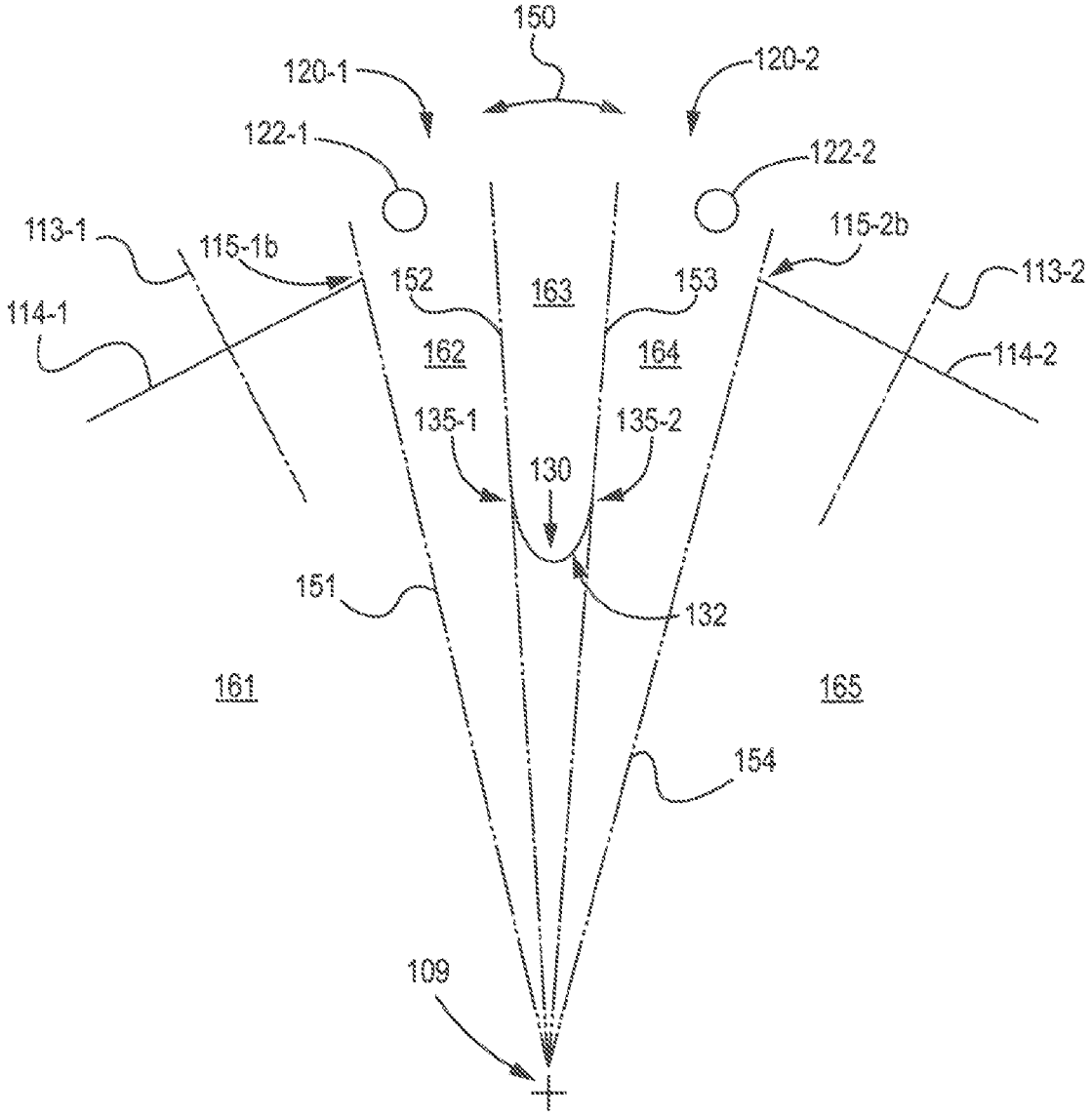
FIG. 4A illustrates a top view of the circumferential spacing of elements of the splicing apparatus of FIG. 3.

FIG. 4A illustrates a top view of the circumferential spacing of elements of the splicing apparatus of FIG. 3. Throughout the present disclosure, a circumferential location refers to the relative locations of elements, with respect to reference lines radiating out from the downstream infeed location 109. For example, if a first reference line radiates out from the downstream infeed location, and a second reference line radiates out from the downstream infeed location, and a reference point exists in the sector that is bounded by the first and second reference lines, then the reference point is disposed circumferentially between the first and second reference lines. Also, throughout the present disclosure, radial spacing 170 refers to locations of elements in terms of distance from the downstream infeed location 109, with 171 referring to radially inboard (relatively closer to the downstream infeed location 109) and 171 referring to radially outboard 179 (relatively farther the downstream infeed location 109).

FIG. 4A includes reference lines 151, 152, 153, and 154, which define boundaries for sectors are 161, 162, 163, 164, and 165. Reference line 151 extends from the downstream infeed location 109 through a radially farthest point 115-1*b* on the first circular path 114-1. Reference line 151 defines one side of the sector 161. Reference line 152 extends from the downstream infeed location 109 through a circumferentially farthest point 135-1 on one side of the contact surface 132 of the splice wrap housing 130. Reference lines 151 and 152 define the sides of the sector 162. Reference line 153 extends from the downstream infeed location 109 through a circumferentially farthest point 135-2 on the other side of the contact surface 132 of the splice wrap housing 130. Reference lines 152 and 153 define the sides of the sector 163. Reference line 154 extends from the downstream infeed location 109 through a radially farthest point 115-2*b* on the second circular path 114-2. Reference line 154 defines one side of the sector 165.

In FIG. 4A, the first circular path 114-1 is disposed in sector 161, the first collapsible splice trigger 120-1 is disposed in sector 162, the splice wrap housing 130 is disposed in sector 163, the second collapsible splice trigger 120-2 is disposed in sector 164, and the second circular path 114-2 is disposed in sector 165.

Figure 4B:
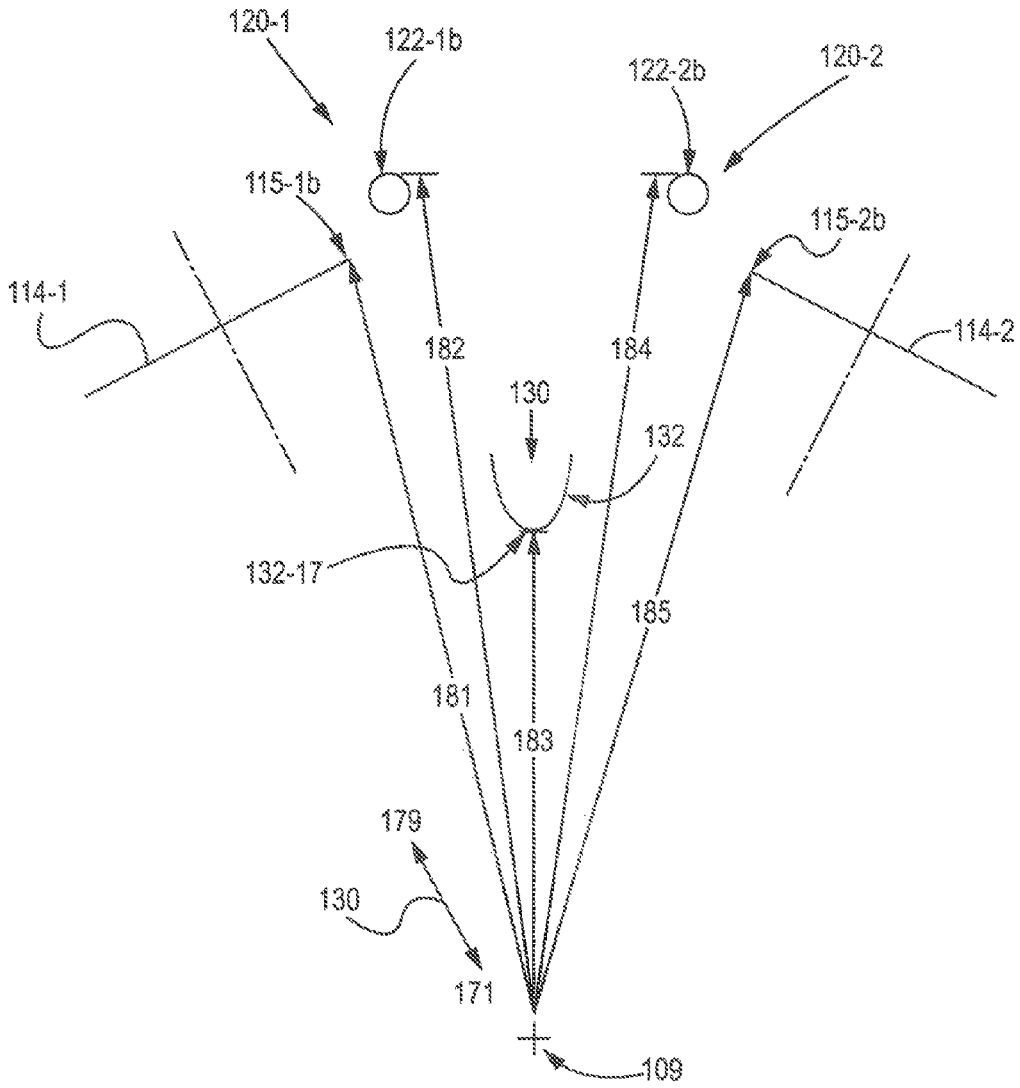
FIG. 4B illustrates a top view of the radial spacing of elements of the splicing apparatus of FIG. 3.

FIG. 4B illustrates a top view of the radial spacing of elements of the splicing apparatus of FIG. 3. The first circular path 114-1 has the farthest point 115-1*b* that is farthest radially outboard 179 from the downstream infeed location 109, as measured by the distance 181. The first collapsible splice trigger 120-1 has a farthest point 122-1*b* on the first contact surface 122-1 that is farthest radially outboard 179 from the downstream infeed location 109, as measured by the distance 182. The splice wrap housing 130 has a nearest point 132-17 on the strand contact surface 132 that is closest radially inboard 171 to the downstream infeed location 109, as measured by the distance 183. The second collapsible splice trigger 120-2 has a farthest point 122-2*b* on the second contact surface 122-1 that is farthest radially outboard 179 from the downstream infeed location 109, as measured by the distance 184. The second circular path 114-2 has the farthest point 115-2*b* that is farthest radially outboard 179 from the downstream infeed location 109, as measured by the distance 185.

Distance 182 is greater than distance 181 and distance 183. In FIG. 4B, distance 181 is greater than distance 183, although in various embodiments this is not required. Distance 184 is greater than distance 183 and distance 185. In FIG. 4B, distance 185 is greater than distance 183, although in various embodiments this is not required. In FIG. 4B, distance 181 is equal to distance 185, and distance 182 is equal to distance 184, although in various embodiments these relationships are not required.

Figure 5A:
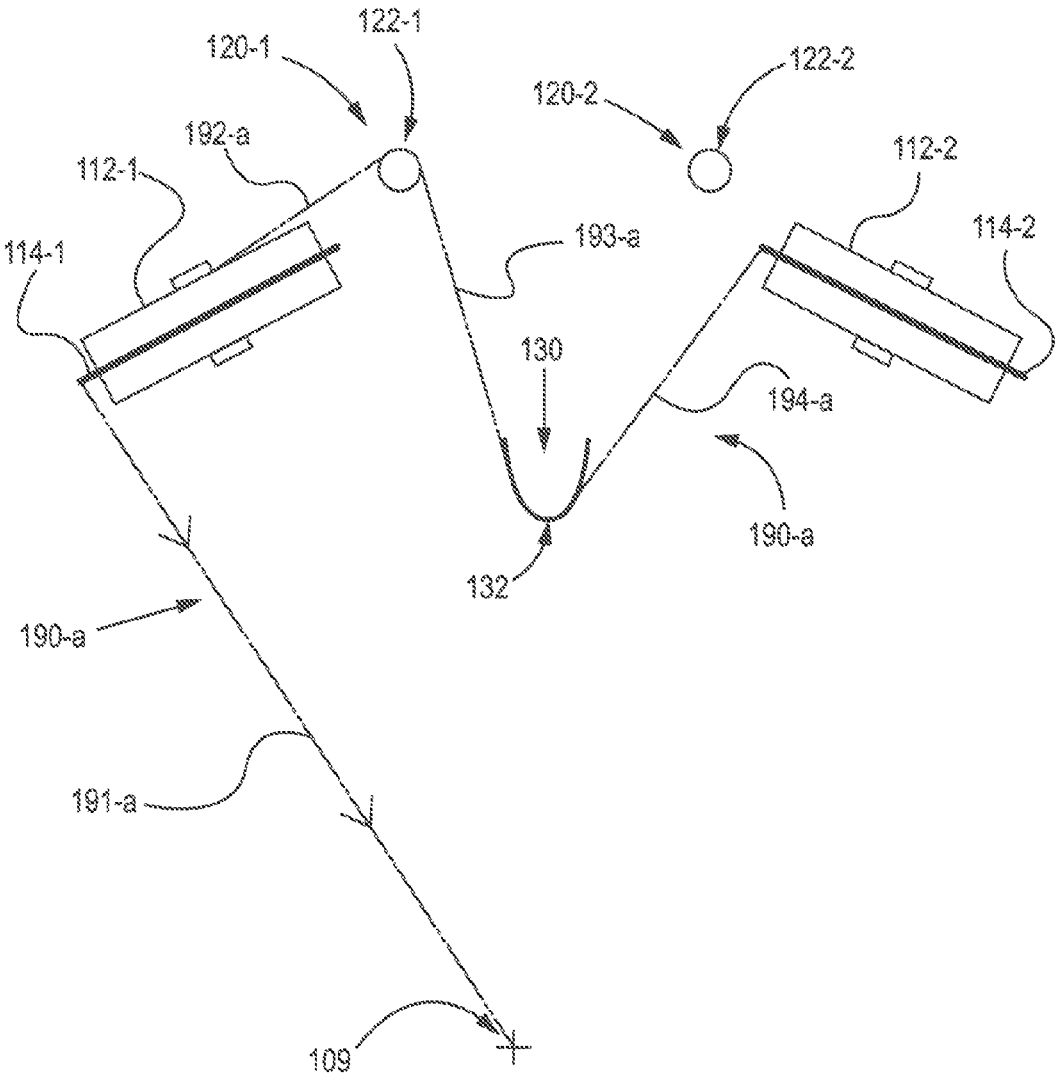
FIG. 5A illustrates a top view of a joined strand threaded up in the splicing apparatus of FIG. 1.

FIG. 5A illustrates a top view of a joined strand threaded up in the splicing apparatus of FIG. 1, with the first package 112-1 in the first unwind station 110-1 as the active package and the second package 112-2 in the second unwind station 110-2 as the standby package. The first package 112-1 has a first strand and the second package 112-2 has a second strand. A trailing end of the first strand is joined to a leading end of the second strand, to form a joined strand.

The joined strand is routed with an active package strand routing 190-*a* that has a number of routing legs. In the embodiments of FIGS. 5A-5D, each of the routing legs is shown as substantially linear, however in various embodiments this is not required. The strand routing 19Q-a includes a first routing leg 191-*a* from the downstream infeed location 109 to the first strand guide of the first rotating arm on the first circular path 114-1. From the trailing end of the first strand (disposed near a core of the first package 112-1), the joined strand is disposed around the first contact surface 122-1 of the first collapsible splice trigger 120-1, forming a second routing leg 192-*a*. From first contact surface 122-1, the joined strand is also disposed around the contact surface 132 of the splice wrap housing 130, forming a third routing leg 193-*a*. From the contact surface 132 of the splice wrap housing 130, the joined strand is further disposed on the second strand guide of the second rotating arm on the second circular path 114-2, forming a fourth routing leg 194-*a*. As the joined strand is unwound and transferred from the active first package 112-1 to the standby second package 112-2, the strand follows the strand routing 190-*a*, which then changes, as part of the splicing, as described below.

Figure 5B:
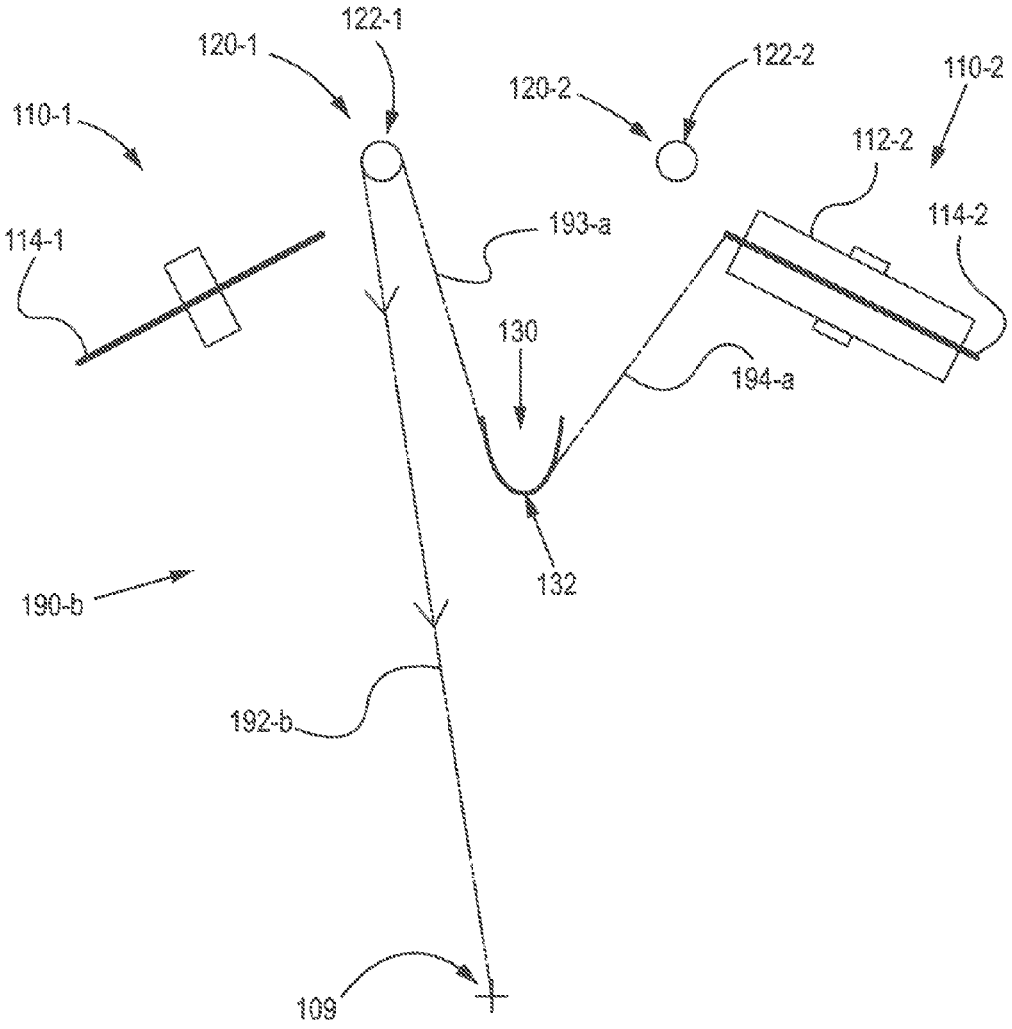
FIG. 5B illustrates a top view of the joined strand of FIG. 5A, as the joined strand is being transferred from an active package to a standby package.

FIG. 5B illustrates a top view of the joined strand of FIG. 5A, with a splicing strand routing 190-*b*, as the joined strand is being transferred from the formerly active package in the first package unwind station 110-1 to the standby package in the second package unwind station 110-2 After the active package is fully unwound (leaving a core in the first unwind station 110-1), the joined strand is pulled off of the strand guide of the first rotatable arm, and off of the core in the first unwind station 110-1; then tension in the joined strand pulls the joined strand toward the downstream infeed location 109. This eliminates the first routing leg 191-*a* and creates a new second routing leg 192-*b*, from the first contact surface 122-1 of the first collapsible splice trigger 120-1 to the downstream infeed location 109.

Tension in the strand pulls the pin of the first collapsible splice trigger 120-1 in the collapse direction, which is toward the downstream infeed location 109. When the tension creates a pulling force that reaches the predetermined force for the first collapsible splice trigger 120-1, the first collapsible splice trigger 120-1 collapses. Tension in the joined strand again pulls the joined strand toward the downstream infeed location 109, and the joined strand is unwrapped from the contact surface 132 of the splice wrap housing 130. This eliminates the second routing leg 192-*b* and the third routing leg 193-*a*. The joined strand is transferred to the standby package, which is the second package 112-2.

Figure 5C:
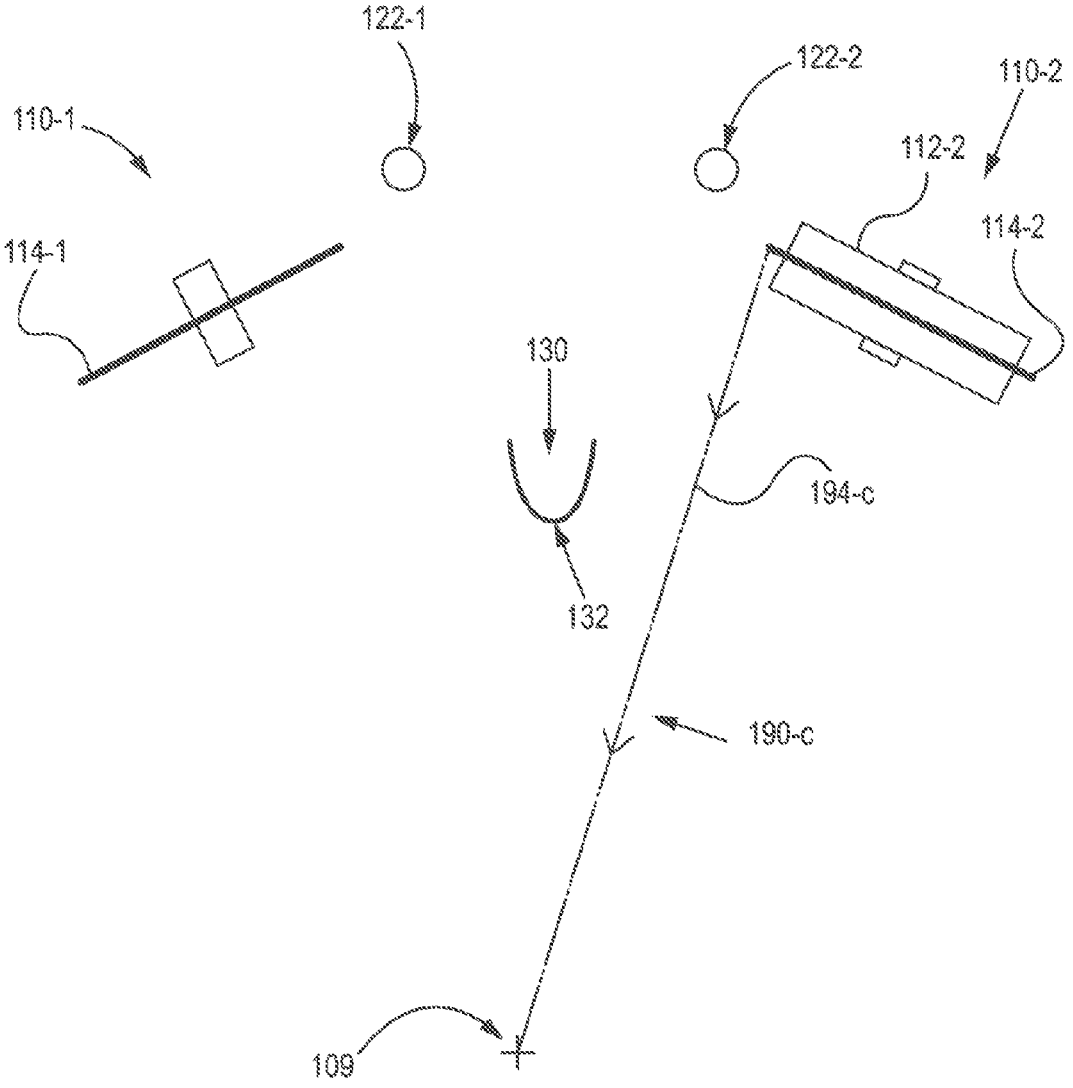
FIG. 5C illustrates a top view of the joined strand of FIG. 5B, after the joined strand is transferred to the standby package.

FIG. 5C illustrates a top view of the joined strand of FIG. 5B, with a standby package strand routing 190-*c*, after the joined strand is transferred to the second package 112-2. When the joined strand is transferred to the second package 112-2, this creates a new fourth routing leg 194-*c*, from the downstream infeed location 109 to the second strand guide of the second rotating arm on the second circular path 114-2. The second package 112-2, which was formerly the standby package, becomes the new active package.

Figure 5D:
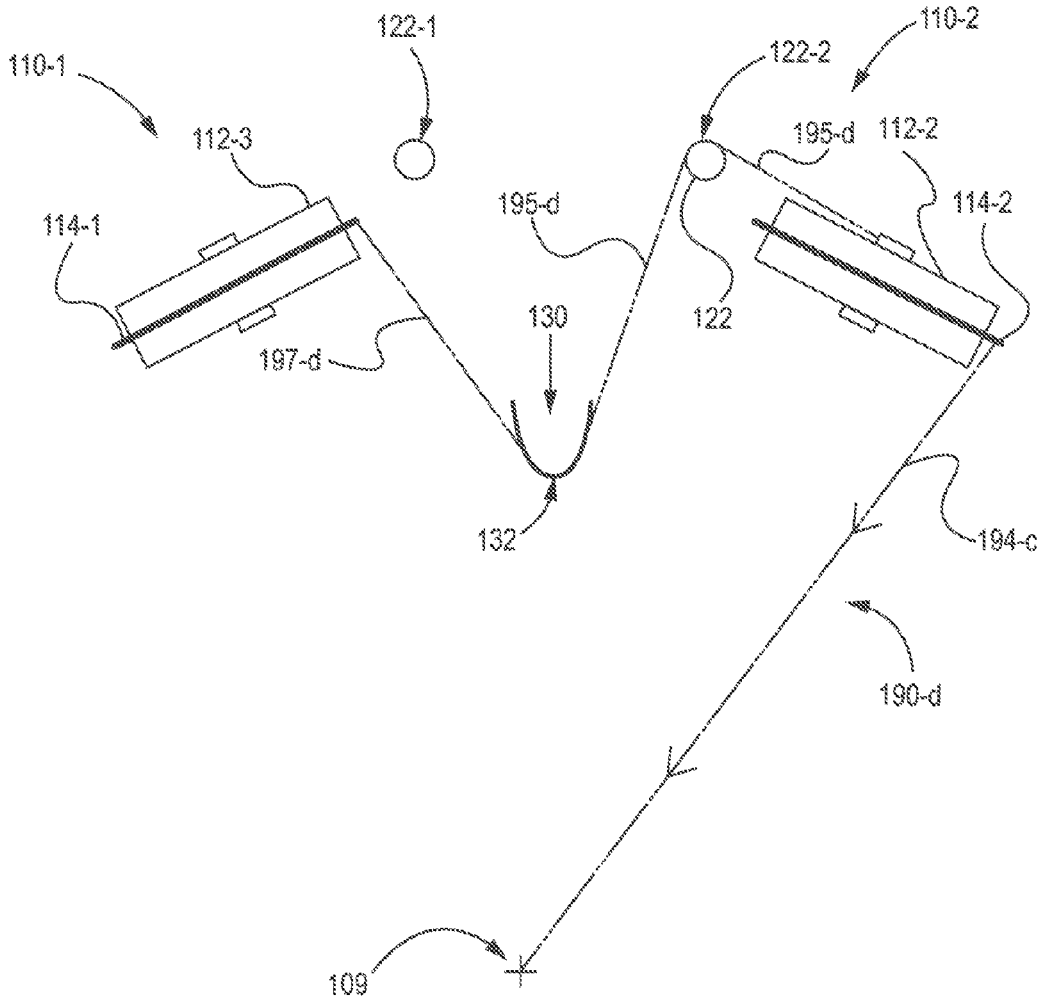
FIG. 5D illustrates a top view of the strand of FIG. 5C, joined to a new standby package.

As shown in FIG. 5D, once the second package 112-2 becomes the new active package, the core from the first package 112-1 can be removed and a new standby package 112-3 can be added to the first package unwind station 110-1 as the new standby package. The second package 112-2 has a second strand and the third package 112-3 has a third strand. A trailing end of the second strand is joined to a leading end of the third strand, to form a newly joined strand.

The newly joined strand is routed with an new active package strand routing 190-*d* that has a number of routing legs. The strand routing 190-*d* includes the fourth routing leg 194-*c* from the downstream infeed location 109 to the second strand guide of the second rotating arm on the second circular path 114-2. From the trailing end of the second strand (disposed near a core of the second package 112-2), the newly joined strand is disposed around the second contact surface 122-2 of the second collapsible splice trigger 120-2, forming a fifth routing leg 195-*d*. From second contact surface 122-2, the newly joined strand is also disposed around the contact surface 132 of the splice wrap housing 130, forming a sixth routing leg 196-*d*. From the contact surface 132 of the splice wrap housing 130, the newly joined strand is further disposed on the first strand guide of the first rotating arm on the first circular path 114-1, forming a seventh routing leg 197-*d*. As the newly joined strand is unwound and transferred from the new active second package 112-2 to the new standby third package 112-3, the strand follows the strand routing 190-*d*, which then changes, as part of the splicing. The splicing is performed from the second package unwind station 110-2 to the first package unwind station 110-1 in the same manner as taught for splicing from the first package unwind station 110-1 to the second package unwind station 110-2, as described above.

Embodiments of the present disclosure use a splicing apparatus to properly route strands of material as the strands are transferred from active packages to standby packages, during the unwinding process. Using the splicing apparatus enables the strand to maintain a proper orientation with respect to the packages, strand guides, and downstream equipment. This is especially useful for processes that unwind strands with rotatable arms. As a result, take off equipment can unwind packages in sequence while continuously feeding the downstream equipment.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A machine for unwinding a strand of material, the machine comprising:

a first package unwind station, configured to unwind a strand from a first package loaded into the first package unwind station to a downstream infeed location, wherein the first package unwind station includes a first apparatus with a first unpowered rotatable arm that includes a first rotational axis and a first strand guide, wherein rotation of the first rotatable arm around the first rotational axis defines a first circular path for a distal end of the first strand guide, wherein the first circular path has a first circular path farthest point that is radially farthest from the downstream infeed location;

a second package unwind station, configured to unwind a strand from a second package loaded into the second package unwind station to the downstream infeed location, wherein the second package unwind station includes a second apparatus with a second unpowered rotatable arm that includes a second rotational axis and a second strand guide, wherein rotation of the second rotatable arm around the second rotational axis defines a second circular path for a distal end of the second strand guide; and a first collapsible splice trigger with a first strand contact surface, wherein the first collapsible splice trigger is disposed circumferentially between the first rotational axis and the second rotational axis, wherein the first strand contact surface has a first strand contact surface farthest point that is radially farthest from the downstream infeed location, and wherein the first strand contact surface farthest point is radially farther from the downstream infeed location than the first circular path farthest point;

a splice wrap housing, wherein the splice wrap housing is disposed circumferentially between the first collapsible splice trigger and the second circular path; wherein the splice wrap housing has a splice wrap strand contact surface with a splice wrap contact surface nearest point that is radially nearest to the downstream infeed location, and wherein the splice wrap contact surface nearest point is radially nearer to the downstream infeed location than the first strand contact surface farthest point; and wherein the second circular path has a second circular path farthest point that is radially farthest from the downstream infeed location, and wherein the second circular path farthest point is radially farther from the downstream infeed location than the splice wrap contact surface nearest point.

2. The machine of claim 1, wherein the first collapsible splice trigger has a first collapse direction, and the first collapsible splice trigger is disposed on the machine such that the first collapse direction is oriented substantially toward the downstream infeed location.

3. The machine of claim 2, wherein the first collapse direction is oriented completely toward the downstream infeed location.

4. The machine of claim 1, wherein the first collapsible splice trigger is disposed between the first circular path and the second rotational axis.

5. The machine of claim 4, wherein the first collapsible splice trigger is disposed between the first circular path and the second circular path.

6. A machine set-up, comprising:

the machine of claim 1;

the first package having a first strand;

the second package having a second strand; and a trailing end of the first strand joined to a leading end of the second strand, to form a joined strand;

wherein the joined strand is routed with a strand routing that is disposed around the first strand contact surface and around the splice wrap strand contact surface.

7. The machine set-up of claim 6, wherein the strand routing wraps around the splice wrap contact surface at an angle of at least 275 degrees.

8. The machine set-up of claim 6, wherein the strand routing wraps around the splice wrap contact surface at an angle of at least 300 degrees.

9. A method for unwinding a strand of material, the method comprising:

providing a first package having a first strand, and a second package having a second strand, wherein a trailing end of the first strand is joined to a leading end of the second strand, to form a joined strand;

unwinding the joined strand from the first package, to a downstream infeed location;

collapsing a first collapsible splice trigger using tension in the joined strand; and after the collapsing, unwinding the joined strand from the second package, to the downstream infeed location;

after the collapsing, unwrapping the joined strand from a splice wrap strand contact surface of a splice wrap housing;

before the unwrapping, holding a second unpowered rotating arm in a predetermined position, wherein the holding includes holding the second unpowered rotating arm in the predetermined position, using a magnetic force; and after the unwrapping, unwinding the joined strand from the second package, to the downstream infeed location.

10. The method of claim 9, wherein the unwinding of the first package includes unwinding the first package with a first unpowered rotating arm.

11. The method of claim 10, including, after the first package is fully unwound, pulling the joined strand off of a strand guide that is attached to the first unpowered rotating arm.

12. The method of claim 11, including, after the first package is fully unwound, pulling the joined strand off of a distal end of the strand guide that is attached to the rotating arm.

13. The method of claim 11, wherein the collapsing occurs after the joined strand is pulled off of the strand guide.

* * * * *